United States Patent [19]

Griffin et al.

[11] Patent Number: 4,681,628

[45] Date of Patent: Jul. 21, 1987

[54] GOLD RECOVERY PROCESSES

[75] Inventors: Arnold F. Griffin, Scarborough; Warren D. Hinchliffe, Morley, both of Australia

[73] Assignee: Norcim Investments Pty. Ltd., Perth, Australia

[21] Appl. No.: 855,406

[22] Filed: Apr. 24, 1986

[30] Foreign Application Priority Data

May 1, 1985 [AU] Australia ..... PH0385

[51] Int. Cl.[4] ..... C22B 11/04

[52] U.S. Cl. ..... 75/118 R; 75/105; 75/108; 423/29; 423/30; 423/31; 423/42; 423/43; 423/101; 204/109; 204/110

[58] Field of Search ..... 75/105, 108, 118 R; 423/29, 30, 31, 42, 43, 101; 204/109, 110

[56] References Cited

U.S. PATENT DOCUMENTS 3,218,161 11/1965 Kunda et al. ..... 75/118 R
4,256,707 3/1981 Flynn, Jr. et al. ..... 423/29
4,273,579 6/1981 Okugawa et al. ..... 75/108
4,595,572 6/1986 Agasa et al. ..... 423/29

*Primary Examiner*—John Doll
*Assistant Examiner*—Robert L. Stoll
*Attorney, Agent, or Firm*—John S. Hale

[57] ABSTRACT

The invention relates to a process for the recovery of gold from an alkaline aqueous liquid solution containing gold-cyanide ion, and possibly silver and/or copper and/or mercury, which comprises adding a quantity of thiourea to the solution so as to allow formation of a gold complex with thiourea which gold complex is soluble and stable in dilute acid solution, then adjusting the pH of the solution to make the solution mildly acidic, whereby gold and mercury remain in solution in the liquid and silver and/or copper is incorporated in a precipitate containing silver and/or copper cyanide compounds, and then separating the precipitate from the liquid to leave a solution of dissolved gold complex and subsequently recovering the gold from the solution.

11 Claims, No Drawings

(S.K.W. Trostburg AG) and Australian Patent Application No. 34738/84 (S.K.W. Trostburg AG). However, all of these patents are involved in the dissolution of gold, whereas the present invention is to separate the gold from other metal complexes in an aqueous solution, after the metals have been dissolved by cyanide.

The present invention will now be illustrated by the following non-limiting Examples. The following Examples 1 to 4 are the results of tests conducted under varying conditions on a stock aqueous solution having a pH of about 10.5 and the following composition:

Gold: 10,000 parts per million
Silver: 1,560 parts per million
Copper: 3,700 parts per million The gold, silver and copper values were contained in the form of cyanide complexes.

EXAMPLE 1

To 50 ml. of liquid stock solution was added 0.23 gms of thiourea (60% stoichiometric for $Au(TU)_2+$) The mixture was heated, with constant stirring to 65° C. Then concentrated hydrochloric acid was added to adjust the pH to 2.9. A precipitate formed. The resultant slurry was filtered to separate the precipitate and the separated precipitate was washed with 2×50 ml. water at 65° C. The separated precipitate contained 5.8% of the gold, 86.4% of the silver and 99.1% of the copper present in the original stock solution. The remaining gold was held in solution in the filtrate liquid.

EXAMPLE 2

The conditions of this test were identical to Example 1 but sulphuric acid was used to adjust the solution pH to 2.65. The separated precipitate contained 6.5% of the gold, and 91.7% and 99.5% of the silver and copper respectively. The remaining gold was held in solution in the filtrate liquid.

EXAMPLE 3

To 100 ml. of the stock solution was added 0.45 gms thiourea. The solution temperature was brought to and maintained at 65°-70° C. with constant stirring. 60% w/w sulphuric acid was added to adjust the pH to 2 and a precipitate was formed. This precipitate was filtered to separate it from the liquid. The separated precipitate was warm water washed. The separated precipitate contained 5.7% of the gold, and 91.5% and 99.6% of the silver and copper respectively. The remaining gold was held in solution in the filtrate liquid. To the filtrate was added 30 ml. conc. sulphuric acid and then 10 ml. saturated calcium hypochlorite ($Ca(OCl)_2$) solution. The $Ca(OCl)_2$ reacts with acid to form $Cl_2$ gas in situ. $Cl_2$ gas is a strong oxidising agent and assists the decomposition of the $Au(CN)_2^-$ complex remaining in the filtrate. About 200 grams or more of $Ca(OCl)_2$ may be used per kilo of gold in the filtrate. $Cl_2$ gas itself may be used as an alternative to $Ca(OCl)_2$. After the addition of $H_2SO_4$ and $Ca(OCl)_2$ the temperature of the filtrate was found to be 80° C. This liquid was then heated to near boiling prior to addition of $SO_2$.

After some 30 minutes had elapsed $SO_2$ gas was passed continually into the filtrate liquid for one hour. The resulting precipitate was filtered off and water washed and found to contain 99.7% of the gold from the filtrate. After annealing the precipitate was estimated to assay 98.2% gold, 1.7% silver and 0.1% copper.

EXAMPLE 4

To 1 liter of stock solution at 65°-70° C. was added 4.5 gms thiourea with vigorous mixing. Then sufficient concentrated sulphuric acid was added to adjust the pH to 2-2.5 followed by agitation for 25 minutes. A precipitate formed. The precipitate after filtration was water washed with 300 mls. of warm water. The separated precipitate contained 3.6% of the gold, and 88.2% and 99.4% of the silver and copper respectively in the stock solution. The remaining gold was held in solution in the filtrate liquid. To the filtrate at 65° C. was added $Ca(OCl)_2$ and 300 mls. 1:1 concentrated sulphuric acid/water. The temperature was raised to 100° C. with constant agitation. The filtrate was then air purged to eliminate excess chlorine and $SO_2$ gas bubbled slowly through it for 2 hours. The resulting precipitate was filtered off and water washed before annealing and assaying. This precipitate was found to contain 99.8% of the gold in the filtrate and a comprehensive assay showed Au 98.22%, Ag 0.86%, Cu 0.15%, Al 0.03%, Si 0.02%, Fe 0.08%, Ni 0.56%, Zn 0.06%, Mo 0.02%, Pb 0.01%. Gold may also be separated from the hot filtrates by addition of reducing agents, such as $SO_2$ or $Na_2SO_3$ and reduction of the pH to preferably 0.5 or less. In one embodiment, air may then be passed through the hot solution for from 1 to 2 hours to degas the solution removing HCN and other gaseous reaction products Sulphur dioxide or sodium sulphite may also be added simultaneously with the air to aid precipitation of the gold.

The solution temperature is maintained at at least 75° C. during the treatment with air.

In another embodiment, the solution acidified with concentrated sulphuric acid is boiled for, for example, from 1-2 hours. Optionally, solid sodium sulphite ($Na_2SO_3$) is added before or during boiling or a continuous stream of sulphur dioxide is passed into the boiling liquid.

As indicated in Examples 5 and 6, the filtrate containing gold-thiourea complex can, at about 70° C., be treated with concentrated sulphuric acid at a rate of at least 4% volume/volume.

This addition makes the filtrate strongly acidic and also adds heat to the system. The addition of sulphuric acid should be enough to reduce the pH of the filtrate to 1.0 or less.

The following Examples 5 and 6 are the results of tests conducted on a stock aqueous solution having a pH of about 10.5 and containing:

Gold: 1850 parts per million
Silver: 340 parts per million
Copper: 1000 parts per million.

The gold, silver and copper values were contained in the form of cyanide complexes.

EXAMPLE 5

500 mls. of the stock solution mentioned above was heated to 70° C., and 0.429 grams of thiourea (66% stoichiometric for gold) was then added. Then 50 mls. of 61.7% w/w $H_2SO_4$ solution was added. A slurry resulted which was filtered to separate the solids from the liquid. The solid cake was washed with 300 mls. of hot water.

It was found that the gold, silver and copper were distributed between the filtrate and solids as follows:

GOLD RECOVERY PROCESSES

The present invention relates to a gold recovery process. The recovery of gold from ores typically comprises the following steps:

1. Crushing/grinding the ore;
2. Agitation with water and alkaline cyanide;
3. Agitation with activated carbon so as to adsorb the gold onto the surface of the carbon particles, followed by separation of the carbon particles by screening;
4. Desorption of the adsorbed gold from the carbon particles; and
5. Recovery of the gold from the eluant usually by deposition of the metals on a cathode of an electrolytic cell, followed by smelting this mixed metal deposit for sale.

However, this mode of recovery is usually slow, inefficient, labour intense and of low security. Further, the composition being electrolysed frequently contains other metals which are co-deposited with the gold particularly silver, copper and mercury. Such base or Doré bullion requires further refining to meet International Standards. The further refining methods are expensive and highly specialised.

All the functions for the recovery of gold described above subjects of many patents and technical publications. There is a need for an improved system of recovering the gold from the carbon eluate.

The present invention provides a gold recovery process which is of general applicability but is particularly envisaged for use with the desorb liquid or eluate produced by the gold desorption process which is the subject of Australian Patent Application No. 90929/82 corresponding to South African Pat. No. 82/8796 and U.S. Pat. No. 4,468,303 and others all in the name of the present applicant.

In accordance with one aspect of the present invention there is provided a process for the recovery of gold from an alkaline aqueous liquid solution containing dissolved gold-cyanide ion, and possibly silver and/or copper and/or mercury, which comprises adding a quantity of thiourea ($CS(NH_2)_2$) to the solution so as to allow formation of a gold complex with thiourea which gold complex is soluble and stable in dilute acid solution, then adjusting the pH of the solution to make the solution mildly acidic (such as a pH in the range from 1 to 4) whereby gold and mercury remain in solution in the liquid and silver and/or copper is incorporated in a precipate containing silver and/or copper cyanide compounds, and then separating the precipitate from the liquid to leave a solution of dissolved gold complex and subsequently recovering the gold from the solution.

Due to the very high stability of the gold-cyanide complex, only part of the gold present in the original solution is converted to the form of the gold complex with thiourea on addition of thiourea and acid. The remainder of the gold present in the filtrate is still in the form of the gold cyanide complex. Thus, the solution of gold complex remaining after separation of the filtrate contains both gold-thiourea complex and gold-cyanide complex.

The gold can be recovered by known methods from the liquid. The present invention is based on the fact that gold cyanide complexes can react with thiourea (TU) in acid solutions to form a gold-thiourea complex as set out in the following equation:

$$Au(CN)_2^- + 2H^+ + 2TU \rightleftharpoons Au(TU)_2^+ + 2HCN.$$

Similar reactions can take place with silver and copper but the formation constant (pK) for the gold-thiourea complex is much higher, e.g.

$Au(TU)_2^+$, pK=21.91

$Ag(TU)_3^+$, pK=13.1

$Cu_2(TU)_4^{2+}$, pK=15.4

$FeSO_4(TU)^{2+}$, pK=6.64

$Zn(TU)_2^{2+}$, pK=1.77

Varying the amount of TU available for complexation allows quite selective precipitation of metals with low formation constants from the gold which will remain in solution in the filtrate as $Au(TU)_2^+$ and gold cyanide complexes.

Thus, it is preferable to assay the solution prior to addition of thiourea to calculate the quantity of thiourea to be added. This leads to the formation of the gold thiourea complex but because of the low pK values noted above and the limited availability of TU little or no silver, or copper thiourea or other metal complexes are formed. Thus, silver and/or copper present is precipitated in the form of cyanide compounds, when the solution is made acid.

If less thiourea is added the amount of gold remaining in the solution will be reduced. If more is added then more silver and copper would be converted to the thiourea complex and also remain in solution. It is found that optimum recovery rates are obtained when the amount of thiourea added is in the range from 50 to 70% stoichiometric for $Au(TU)_2^+$ formation.

The acid which is used is preferably a strong, non-oxidising acid such as concentrated hydrochloric acid or preferably sulphuric acid. The pH of the acidic solution is preferably in the range of pH 1 to pH 4.

Further, for economic reasons it is preferred that the gold solution contains at least 4000 parts per million (ppm) gold although this is not essential. Further still, it is preferred that the process of the present invention be conducted at elevated temperature since this facilitates the chemical reaction and subsequent filtration.

The desorb liquid from the process of Australian Patent Application No. 90929/82 is initially at a temperature of about 100° C. and thus there is no difficulty in treating this solution at elevated temperatures.

The process of the present invention is preferably conducted with the liquid at a temperature of at least 60° C. more preferably in the range from 60°-80° C. The precipitate of silver and copper compounds may also contain certain small amounts of other materials including gold. The precipitate can be readily separated from the liquid by filtration and washing with warm water.

The gold can be recovered from the filtrate by means known to those familiar with the art, i.e. by precipitation by sodium sulphite, sulphur dioxide gas or other known precipitants.

The use of thiourea as a solvent to dissolve gold from ores and other gold bearing material is well known and is the subject of a number of patents including U.S. Pat. No. 4,145,212 (Bodson), U.S. Pat. No. 4,051,026 (Cremers), German Pat. No. 543304 (I.G. Farben Industries AG), Australian Patent Application No. 24414/84

| | GOLD | SILVER | COPPER |
|---|---|---|---|
| FILTRATE | 99.0% | 1.3% | 7.5% |
| SOLIDS | 1.0% | 98.7% | 92.5% |
| TOTAL | 100.0% | 100.0% | 100.0% |

500 mls. of the filtrate above was then treated with 61.7% w/w $H_2SO_4$ solution to reduce the pH from 2.7 to 0.75. This liquid was treated in four batches as set out below:

(A) 125 mls. was boiled for ¾ hr.

(B) 1 gm. $Na_2SO_3$ was added to 125 mls. of liquid which was then boiled for ¾ hr.

(C) 1 gm. $Ca(OCl)_2$ was added to 125 mls. of liquid which was then boiled for ¾ hour. 2 gms of $Na_2SO_3$ was then added and the solution boiled another ¾ hour.

(D) 125 mls. of liquid was heated to 80° C. and bubbled vigorously with air for ¾ hour.

The proportions of metal appearing in the resulting precipitates are set out below.

RESULTS (Figures are metals precipitated)

(A) Au=98.8%; Ag=88.5%; Cu=94.9%
(B) Au=99.2%; Ag=88.5%; Cu=94.9%
(C) Au=71.1%; Ag=82.8%; Cu=97.7%
(D) Au=92.6%; Ag=94.3%; Cu=88.6%

EXAMPLE 6

500 mls. of the stock solution mentioned above was heated to 70° C. and 0.50 grams of thiourea (77% stoichiometric for gold) was then added. Then 60 mls. of 64% w/w $H_2SO_4$ solution was added. A slurry resulted which was filtered to separate the solids from the liquid. The solids cake was washed with 300 mls. of hot water.

It was found that the gold, silver and copper were distributed between the filtrate and solids as follows:

| | GOLD | SILVER | COPPER |
|---|---|---|---|
| FILTRATE | 93.3% | 0.2% | 0.5% |
| SOLIDS | 6.7% | 99.8% | 99.5% |
| TOTAL | 100.0% | 100.0% | 100.0% |

Samples of the filtrate which had a pH of 1.1 were treated as follows:

(A) 4 mls. Conc $H_2SO_4$ was added to 100 mls. of filtrate to reduce the pH to less than 1 and the resulting liquid was then heated to 80° C. and bubbled vigorously with air for 1½ hours.

(B) As in (A) but 8 mls. of conc $H_2SO_4$ were added.

(C) As in (A) but a vigorous stream of $SO_2$ gas was also introduced along with the air.

(D) As in (A) but 15 mls. of 8 g/l $Na_2SO_3$ solution was added over the 1½ hour period.

(E) As in (A) but no air, just boiled for 1½ hours.

(F) As in (E) but add 0.2 gms. $Na_2SO_3$ to filtrate (G) As in (E) but boil for ¾ hour.

RESULTS (Figures are metals precipitated)

(A) Au=99.2%; Ag=100%; Cu=81.2%
(B) Au=99.5%; Ag=100%; Cu=81.2%
(C) Au=99.2%; Ag=100%; Cu=81.2%
(D) Au=98.5%; Ag=100%; Cu=74.6%
(E) Au=99.8%; Ag=100%; Cu=81.2%
(F) Au=99.8%; Ag=100%; Cu=72.7%
(G) Au=95.3%; Ag=100%; Cu=81.2%

ESTIMATED Purity of Precipitated Metals $$\frac{100 \times Au}{Au + Ag + Cu}$$

(A) 99.7%
(B) 99.7%
(C) 99.7%
(D) 99.7%
(E) 99.8%
(F) 99.8%
(G) 99.8%

Many gold bearing deposits also contain substantial amounts of mercury. This metal, which is highly toxic, is often disposed off in waste liquids or retorted to atmosphere.

In the process of the present invention it is found that more than 90% of the mercury typically ends up in the filtrate resulting from acidification after thiourea addition. Further, the mercury remains in solution when the gold is subsequently precipitated out using the technique of Examples 3 to 6. The dissolved mercury values can be readily recovered subsequently using known techniques such as cementation, electrodeposition or precipitation of insoluble salts. Modifications and variations such as would be apparent to a skilled addressee are deemed within the scope of the present invention.

We claim:

1. A process for the recovery of gold from an alkaline aqueous liquid solution containing gold-cyanide ion, and one or more members selected from the group consisting of silver, copper and mercury comprising adding thiourea to the solution so as to allow formation of a gold complex with thiourea in which the gold complex is soluble and stable in an acid solution; adjusting the pH of the solution to an acid pH ranging from 1 to 4 so that gold and mercury remain in solution in the liquid and silver and/or copper is incorporated in a precipitate containing silver and/or copper cyanide compounds; separating the precipitate from the liquid to leave a solution of dissolved gold complex; and recovering the gold from the solution.

2. A process according to claim 1, in which the amount of thiourea added is from 40 to 100% of the stiochiometric amount required for conversion of all of the gold to the form of the gold thiourea complex.

3. A process according to claim 2, in which the amount of thiourea is from 50 to 70% of the said stiochiometric amount.

4. A process according to claim 1 wherein the pH adjustment is effectively concentrated hydrochloric acid or sulphuric acid.

5. A process according to claim 1, in which the alkaline liquid solution contains at least 4000 parts per million gold.

6. A process according to claim 1, which is conducted at elevated temperature during addition of thiourea and acidification.

7. A process according to claim 6, which is conducted at a temperature of at least 60° C. during addition of thiourea and acidification.

8. A process according to claim 6, which is conducted at from 60° to 80° C. during addition of thiourea and acidification.

9. A process according to claim 1, in which the solution of dissolved gold complex has sulphuric acid added to it to reduce the pH to 1.0 or less.

10. A process according to claim 9, in which air is passed into the solution after the addition of sulphuric acid whilst the solution is maintained at at least 75° C. until a precipitate of gold is obtained.

11. A process according to claim 9, in which the solution is boiled after the addition of concentrated sulphuric acid until a precipitate of gold is obtained.

* * * * *